US006726580B2

(12) United States Patent
Peterson

(10) Patent No.: US 6,726,580 B2
(45) Date of Patent: Apr. 27, 2004

(54) FOOTBALL STYLE THROWN OBJECTS HAVING LIGHT STICKS

(76) Inventor: Lloyd E. Peterson, 13205 Lakeview Dr., Burnsville, MN (US) 55337

( * ) Notice: Subject to any disclaimer, the term of this patent is extended or adjusted under 35 U.S.C. 154(b) by 0 days.

(21) Appl. No.: 10/126,278

(22) Filed: Apr. 19, 2002

(65) Prior Publication Data

US 2003/0199344 A1 Oct. 23, 2003

(51) Int. Cl.[7] ..... A63B 43/06
(52) U.S. Cl. ..... 473/570; 473/613
(58) Field of Search ..... 473/570, 571, 473/572, 573, 596, 597, 599, 613; 273/DIG. 24

(56) References Cited

U.S. PATENT DOCUMENTS 4,015,111 A * 3/1977 Spector ..... 473/570
4,479,649 A * 10/1984 Newcomb et al. ..... 473/570
4,695,055 A * 9/1987 Newcomb et al. ... 273/DIG. 24
4,717,158 A * 1/1988 Pennisi ..... 473/570
4,930,776 A * 6/1990 Newcomb et al. ..... 473/570
5,066,012 A * 11/1991 Stark ..... 473/570
5,080,359 A * 1/1992 Thill ..... 473/570
5,186,458 A * 2/1993 Redondo ..... 473/570
5,316,293 A * 5/1994 Hamilton ..... 473/570
5,683,316 A * 11/1997 Campbell ..... 473/570

OTHER PUBLICATIONS

Star Lite Products Catalog dated 2002 showing Nite Lite golf ball (p. 1) and glow sticks (p. 2) for Nite Lite golf ball.
Linkaway Golf web page showing availability of Nite Lite golf ball since Jun. 6, 1999 under Star Lite Products listing (p. 7).
Photograph (undated) showing Nite Lite golf ball.

* cited by examiner

*Primary Examiner*—Steven Wong
(74) *Attorney, Agent, or Firm*—James W. Miller

(57) ABSTRACT

A thrown object having a body shaped at least partially like an American football includes a light stick carried thereon for illuminating the object as it is thrown through the air. The light stick can be carried in an interior bore passing at least partially through the body of the object. The body may be made at least partially from a material capable of transmitting light to allow the light produced by the light stick to be visible through the body. Alternatively, one or more light sticks can be attached to the body of the object in exterior grooves. The light sticks produce light using a chemical reaction after the light sticks are first snapped and shaken.

18 Claims, 5 Drawing Sheets

2
A
A
4
6
8
6
A

FOOTBALL STYLE THROWN OBJECTS HAVING LIGHT STICKS

TECHNICAL FIELD

This invention relates to a thrown recreational object, such as a football, having at least one light stick carried thereon which is visible after the object is thrown as the object passes through the air.

BACKGROUND OF THE INVENTION

Various recreational or sporting activities utilize objects that are thrown through the air by the user. For example, the game of American football uses an oval shaped ball, known as a football, which can be passed or kicked by those playing the game. In addition, simply tossing or passing a football around among friends is a popular recreational activity. Some footballs are made from a soft spongy material only for such recreational activities. One such recreational football is known as a POOF® ball.

Other thrown objects are known which resemble a football at least in part. For example, mini-footballs carrying a set of tail fins are known. The user grips the football shaped portion of this object to throw the object through the air much like a regular sized football with the tail fins stabilizing the flight of the object. These objects, which are also called aerial throwing bombs, are used purely for recreational activities. One such thrown object of the aerial throwing bomb type is currently marketed under the VORTEX™ trade name.

Football style thrown objects as described above are fun to use and play with. However, they are not illuminated and cannot be used at night or in dark places. The Applicant believes that their play and entertainment value would be greatly enhanced if such objects were illuminated in a convenient and durable fashion.

SUMMARY OF THE INVENTION

This invention relates to a thrown object that includes at least one light stick for providing illumination as the object is thrown through the air.

One aspect of this invention relates to a thrown object that at least partially resembles a football. The object includes an oval body that may be gripped by one hand of the user and passed through the air in the manner of an American football. At least one light stick is carried on the body for providing illumination as the object travels through the air.

Another aspect of this invention relates to a thrown object that may be thrown through the air by a user. The object includes a body that is made at least partially from a material that is capable of transmitting light with the body being sized to be able to be gripped by one hand of the user and thrown through the air. The body includes an interior bore that is at least partially covered by the light transmitting material in the body. A light stick is received in the bore for illuminating the object through the light transmitting material of the body after the light stick is activated to cause the light stick to glow.

BRIEF DESCRIPTION OF THE DRAWINGS

This invention will be described more completely in the following Detailed Description, when taken in conjunction with the following drawings, in which like reference numerals refer to like elements throughout.

DETAILED DESCRIPTION

Figure 1:
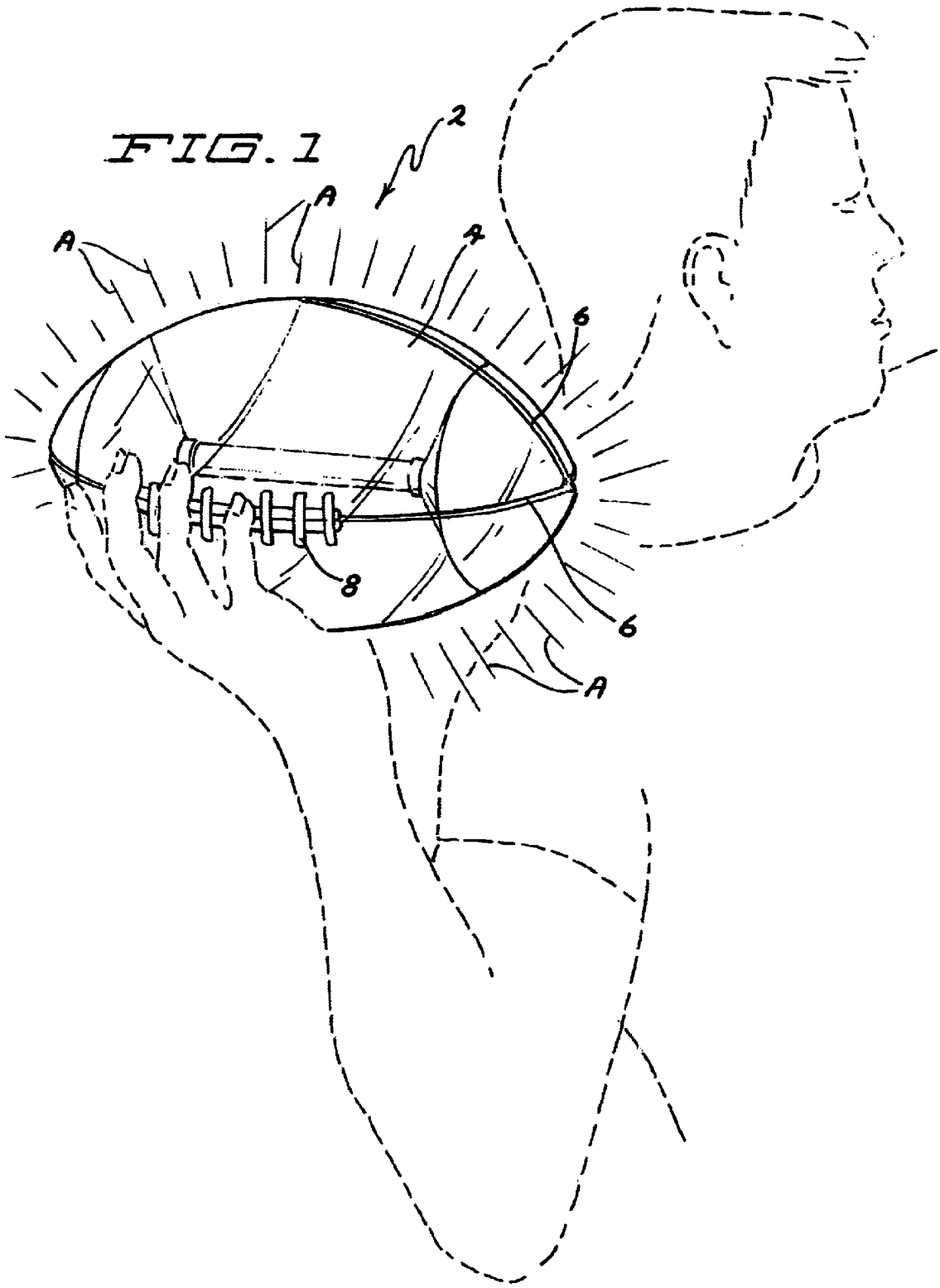
FIG. 1 is a perspective view of a first embodiment of a football style thrown object according to this invention, particularly illustrating the user about to throw or pass the football style thrown object.
Figure 3:
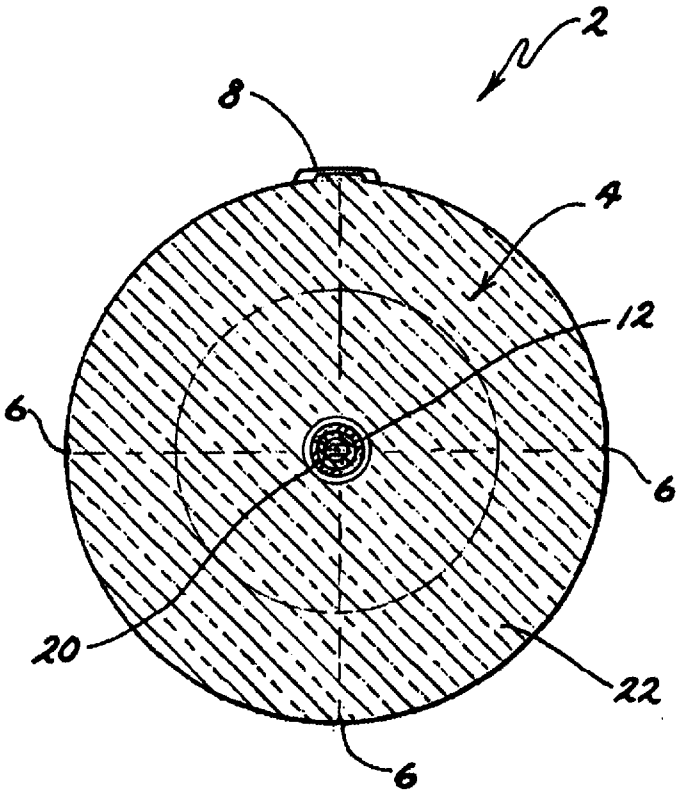
FIG. 3 is a cross-sectional view of the football style thrown object shown in FIG. 1, taken along lines 3—3 in FIG. 2.
Figure 2:
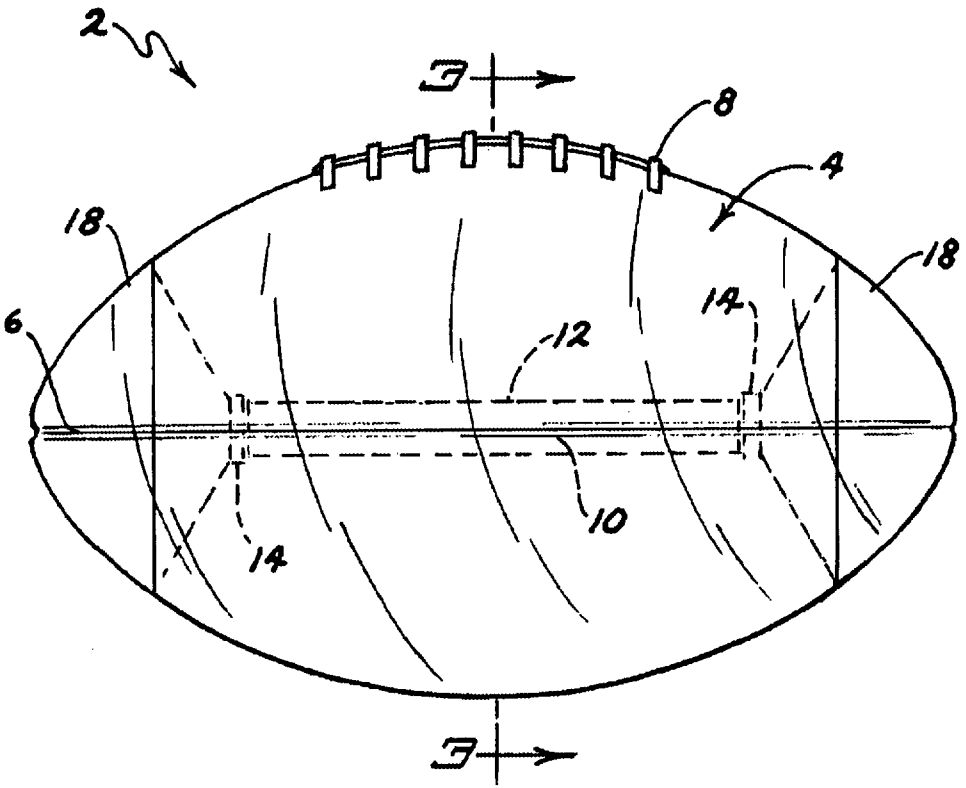
FIG. 2 is a side elevational view of the football style thrown object shown in FIG. 1.

A first embodiment of a football style thrown object according to this invention is illustrated generally in FIGS. 1–4 as 2. Thrown object 2 comprises an oval body 4 shaped like an American football. Body 4 includes four exterior longitudinal axes or seams 6 that are spaced apart 90° around the periphery of body 4. Seams 6 come together at each end of body 4 on the longitudinal centerline $c_l$ of body 4. One seam 6 may include a set of laces 8 for the user to be able to better grip body 4.

As shown in FIG. 1, the user can grip body 4 with one hand and toss or pass the thrown object through the air in a well known manner as is often seen in the game of American football. Body 4 is largely made of a soft, spongy material such that thrown object 2 does not comprise a regulation American football having an inflatable interior bladder. In this case, laces 8 are not real laces but are simply simulated laces provided on the exterior of body 4 by molding laces 8 into body 4. The use of a soft, spongy material reduces the weight of body 4, makes body 4 easier to throw, and reduces the risk of injury if someone is struck by body 4. Recreational type footballs are well known that are made of such a soft, spongy material.

Body 4 includes a bore 10 along longitudinal centerline $c_l$ of body 4 extending interiorly of body 4 over at least the central portion of body 4. See FIGS. 2–4. Bore 10 is formed from a plastic tube 12 that is made from a material capable of transmitting light. Each end 14 of tube 12 carries screw threads 16. Each rounded end of body 4 comprises a removable end cap 18 to provide access to tube 12 forming bore 10. Each removable end cap 18 is provided with screw threads 19 that mate with screw threads 16 on tube 12 for removably coupling end cap 18 to tube 12.

The central portion of body 4, namely that portion overlying and surrounding tube 12 in body 4, is made of a soft, spongy material 22 that is capable of transmitting light, i.e. is translucent or transparent. End caps 18 could be made of the same material as the central portion of body 4 in which case screw threads 19 would be formed on a separate piece that is embedded in the spongy material forming end caps 18. However, end caps 18 are preferably made of a relatively rigid material to allow screw threads 19 to be integrally formed or molded on end caps 18. End caps 18 could be made of a material that is capable of transmitting light or could be made from a material that does not transmit light.

While each rounded end of body 4 has been shown as being a removable end cap 18 to provide access to either end of tube 12, only one end need be a removable end cap 18 with access then being provided to only one end of tube 12. In this event, the other rounded end of body 4 would simply be formed integrally with the rest of body 4 and the other end of tube 12 adjacent such integrally formed rounded end could be closed.

The purpose for making at least one end of body 4 as a removable end cap 18 is to allow a light stick 20, which is also sometimes referred to as a glow stick, to be removably inserted into tube 12 within body 4. Light sticks 20 are themselves well known and comprise flexible plastic tubes that enclose a chemical carrying capsule. When light sticks 20 are bent and snapped, the capsule is broken to allow the chemicals to be mixed by shaking light sticks 20. The chemicals then react to produce a vibrant light.

Light sticks 20 come in different lengths and different diameters and can produce light of different colors. This light lasts for a number of hours once the chemical reaction begins. Light sticks 20 do not glow or give off light prior to the time they are activated or after the chemical light producing reaction is over. One type of light stick 20 that may be used is that known as a Beaver Safety Light Stick manufactured by Clean-Cut Skin Enterprise Co., Ltd. in Taichung, Taiwan.

Figure 4:
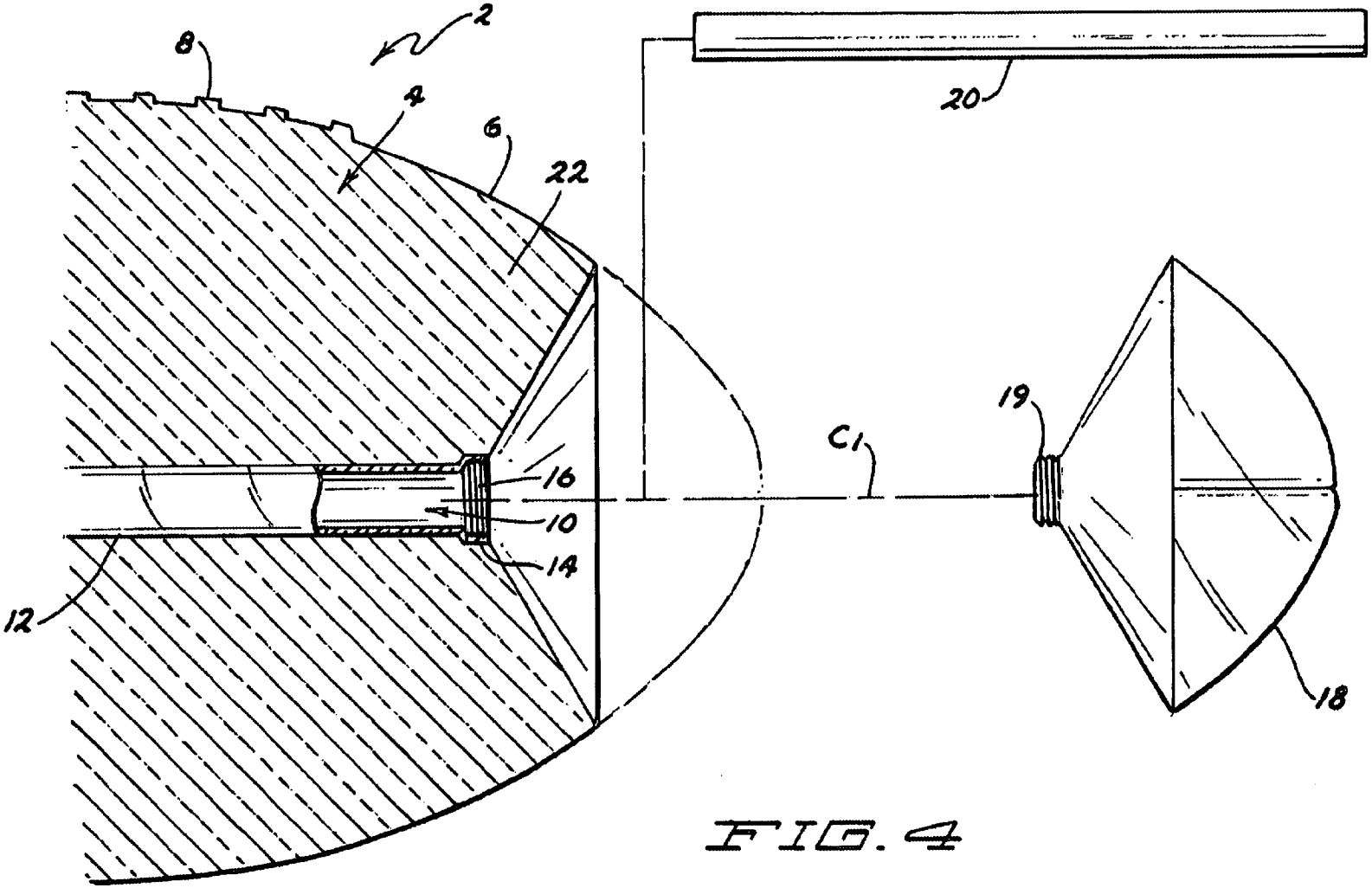
FIG. 4 is a partial cross-sectional view of the football style thrown object shown in FIG. 1, shown in exploded form with an end cap removed and prior to the light stick being inserted into the interior bore.

Referring now to FIG. 4, one removable end cap 18 can be removed by screwing end cap 18 off one end of tube 12 within body 4. A light stick 20 sized to be received within tube 12 in a sliding and preferably non-press type fit is selected. Light stick 20 is snapped and shaken to activate the light producing chemical reaction described above. Light stick 20 is then slid into tube 12 until light stick 20 is received within tube 12. End cap 18 is then reattached to body 4 by screwing end cap 18 back onto the end of tube 12. Once end cap 18 is reattached, end cap 18 blends back in to the rest of body 4 so that there is no large gap between the rest of body 4 and end cap 18.

Once light stick 20 is activated and inserted into body 4 as described above, the user can then play with thrown object 2 in the usual manner by tossing or passing thrown object 2. The light given off by light stick 20 will be transmitted through tube 12 and through the light transmitting material that makes up the central portion of body 4. The light rays A in FIG. 1 depict light passing from light stick 29 through tube 12 and the central portion of body 4. The light given off in this manner while light stick 20 is activated and produces light enhances the entertainment and play value of thrown object 2 and allows thrown object 2 to be used at night or in dark places, such as indoor stadiums or the like.

Figure 5:
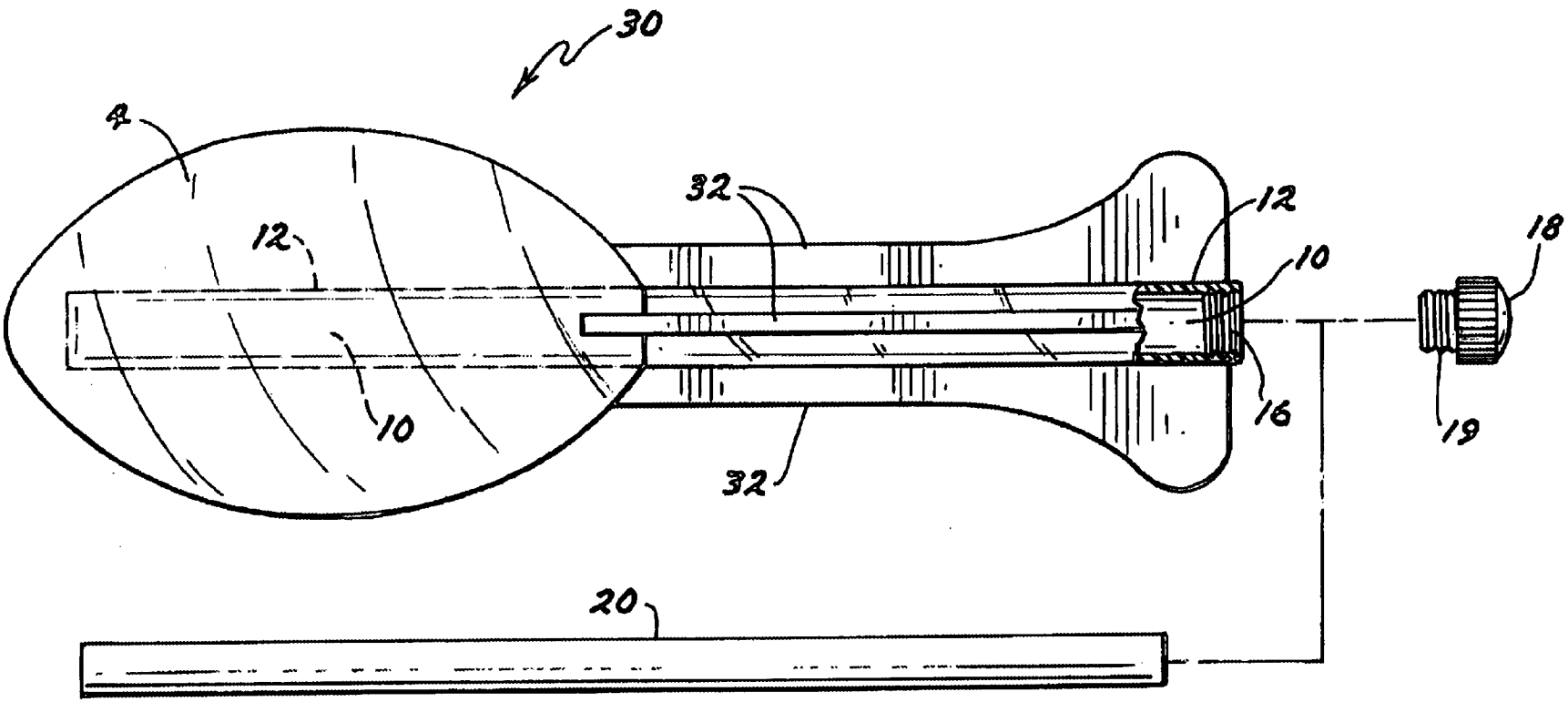
FIG. 5 is a side elevational view of a second embodiment of a football style thrown object according to this invention, shown in exploded form with an end cap removed and prior to the light stick being inserted into the interior bore.

Another embodiment of a football style thrown object according to this invention is illustrated in FIG. 5 as 30. In this embodiment, oval body 4 is smaller than in the first embodiment such that the user's hand can grip around most of body 4. In addition, a set of tail fins 32 protrudes to one side of body 4. Tail fins 32 are mounted on a portion of tube 12 that extends outside of body 4. Thrown objects of the type shown in FIG. 5, i.e. small or mini-footballs with a set of tail fins, are themselves known per se.

In this invention, tube 12 that mounts tail fins 32 also extends inside oval body 4 along longitudinal centerline $c_l$. Thus, tube 12 is both interiorly and exteriorly located relative to body 4. Tube 12 can be made wholly or partially of a light transmitting material. For example, only the portion of tube 12 within body 4 could be made of a light transmitting material or the entire length of tube 12 could be made of a light transmitting material, or only the portion of tube 12 exterior of body 4 could be made of a light transmitting material.

In addition, the end of tube 12 within body 4 is closed, either by an end wall or by the material of body 4. The other exterior end of tube 12 is open. The open end of tube 12 can have screw threads 16 so that an end cap 18 can be removably screwed thereto. In this case, end cap 18 does not form any portion of body 4 but is simply a plug for the exterior end of tube 12. End cap 18 could have a press fit to tube 12 rather than a screw connection.

It should be apparent that the thrown object 30 shown in FIGS. 1–5 is used much like that shown in FIGS. 1–4. The user merely opens the end of tube 12 by removing end cap 18. The user than takes a light stick sized to slide into tube 12 and snaps and shakes light stick 20 to activate the light producing reaction. The user then slides light stick 20 into tube 12 with a portion of light stick 20 being received inside body 4 and the rest of light stick 20 being received in that portion of tube 12 carrying tail fins 32. End cap 18 is then reattached to prevent light stick 20 from falling out of tube 12.

The light produced by light stick 20 shines through tube 12 to illuminate thrown object 30 as it is used. The material comprising body 4 in thrown object 30 is preferably made of the same soft, spongy, light transmitting material described with respect to body 4 of the first embodiment. Thus, the light given off by light stick 20 also passes through body 4 as thrown object 30 passes through the air.

Tubes 12 used to hold light sticks 20 in the first two embodiments can be sized to be approximately ½ inch or larger in diameter such that light stick 20 can be about ½ inch in diameter. Thus, a light stick 20 having a diameter only slightly less than the diameter of tube 12 can be easily slid into and removed from tube 12 when end cap 18 is removed. The user removes a used light stick 20 simply by removing end cap 18 and tipping the thrown object 2 or 30 on end until light stick 20 slides out through the open end of tube 12. A fresh, newly activated light stick 20 can then be inserted into tube 12. A light stick 20 of a diameter of approximately ½ inch provides a significant amount of light.

Figure 7:
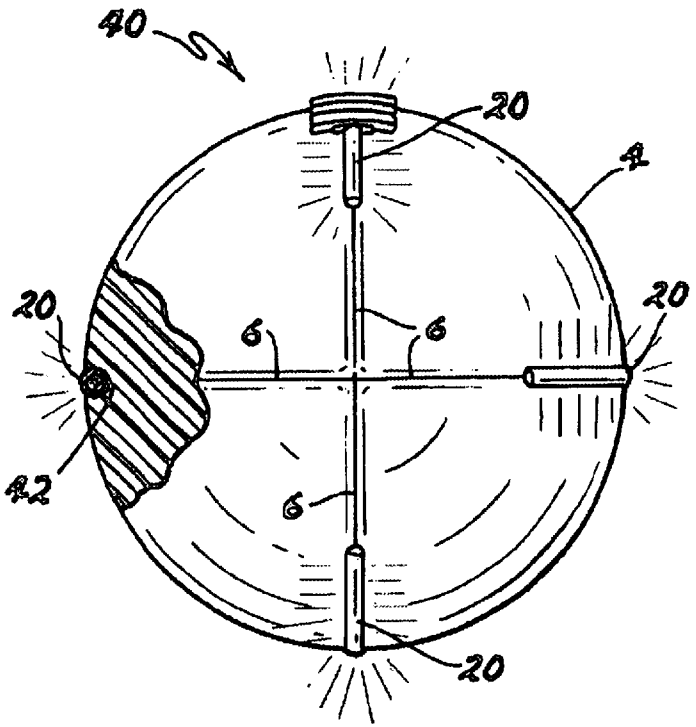
FIG. 7 is an end elevational view, partly in cross-section, of the football style thrown object shown in FIG. 6.
Figure 6:
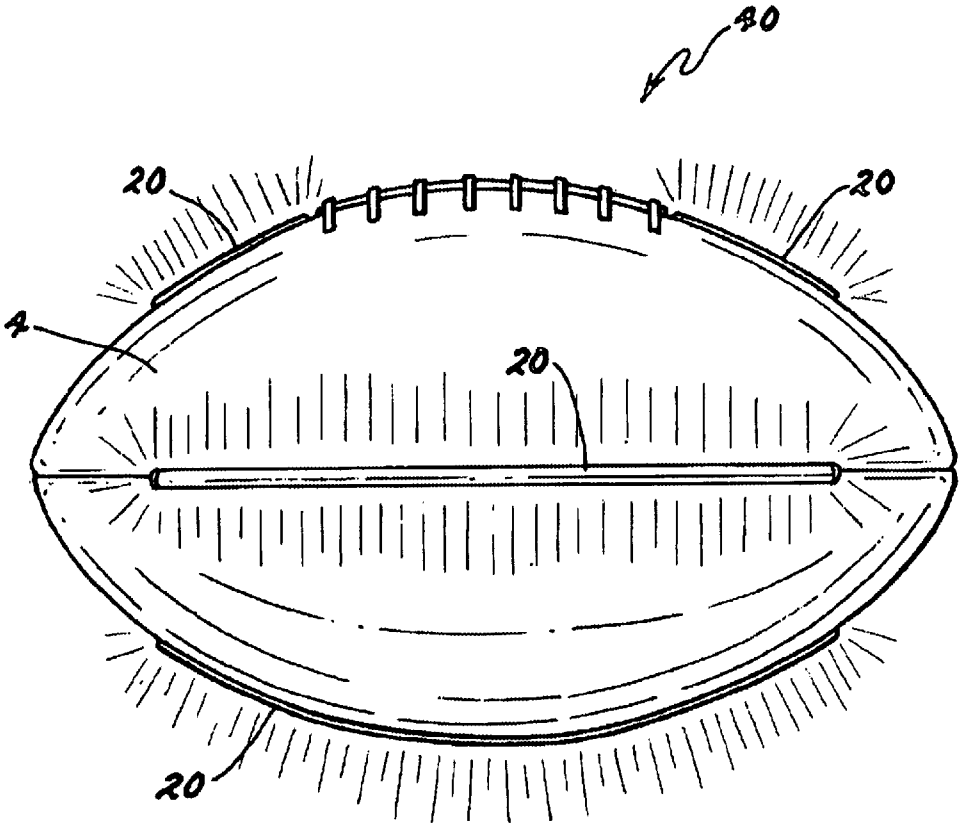
FIG. 6 is a side elevational view of a third embodiment of a football style thrown object according to this invention, particularly illustrating a plurality of light sticks held in exterior grooves along the longitudinal axes of the thrown object.

In the first two embodiments of this invention as shown in FIGS. 1–5, light stick 20 is slidably inserted into a tube 12 forming a bore 10 that is at least partially surrounded by portions of oval body 4 of thrown object 2 or 30. FIGS. 6 and 7 show another embodiment of this invention in which light stick 20 is not so contained. The thrown object of the third embodiment is illustrated generally as 40.

Thrown object 40 also includes an oval body 4 shaped like a football. Instead of a single light stick 20 contained in an bore 10 or tube 12, a plurality of smaller diameter light sticks 20 are press fit into grooves 42 provided on one or more of the exterior seams 6 of body 4. As shown in FIGS. 6 and 7, light sticks 20 are provided on each of the exterior seams 6, though light sticks 20 could be provided on less than all of seams 6. For seam 6 having laces 8, a plurality of light sticks 20 are used with one light stick 20 being received in groove 42 on each side of laces 8. This allows laces 8 to be unobstructed so that the user can better grip laces 8.

In thrown object 40 of FIGS. 6 and 7, light sticks 20 are first snapped and shaken before being inserted into exterior grooves 42. As thrown object 40 passes through the air, light sticks 20 are obviously visible and provide pleasing illumination. In the case of thrown object 40 of FIGS. 6 and 7 using external light sticks 20, body 4 of thrown object 40 need not be made of a light transmitting material. Thus, thrown object 40 could be made much like a regulation American football, using an exterior leather covering which is inflated by an interior bladder, with the exception that seams 6 in the covering would have to be provided with grooves 42 into which light sticks 20 are press fit.

Various additional modifications of this invention will be apparent to those skilled in the art. Thus, the scope of this invention is to be limited only by the appended claims.

I claim:

1. A football style thrown object, which comprises:

a) an oval body that may be gripped by one hand of the user and passed through the air in the manner of an American football, wherein the body has a longitudinal centerline;

b) a light stick carried at least partially in an interior of the body in an elongated bore located along the longitudinal centerline of the body for providing illumination as the object travels through the air, wherein the light stick produces light using a chemical light producing reaction after the light stick is activated; and c) wherein a tube forms the bore, the tube being formed at least partially of a material capable of transmitting light.

2. The football style thrown object of claim 1, wherein the light stick is carried entirely in the interior of the body.

3. The football style thrown object of claim 1, wherein at least a portion of the body overlying and surrounding the tube that carries the light stick is made of a material that is capable of transmitting light such that light produced by the light stick is transmitted through the light transmitting portion of the body to be visible.

4. The football style thrown object of claim 1, further including a removable end cap for at least one end of the tube to allow access to be had to the tube for inserting the light stick into the tube.

5. The football style thrown object of claim 4, wherein the removable end cap forms one end of the body.

6. The football style thrown object of claim 1, further including a set of tail fins protruding from one side of the body, and wherein the tube that carries the light stick extends both inside the body and outside of the body through the tail fins with the tail fins being mounted at least partially on a portion of the tube extending outside of the body.

7. A football style thrown object, which comprises:

a) an oval body that may be gripped by one hand of the user and passed through the air in the manner of an American football, wherein the body has a longitudinal centerline;

b) a tube located along the longitudinal centerline of the body with at least a portion of the tube extending outside of the body;

c) a set of tail fins mounted at least partially on the portion of the tube extending outside of the body; and d) a light stick inserted within the tube for providing illumination as the object travels through the air, wherein the light stick produces light using a chemical light producing reaction after the light stick is activated.

8. The football style thrown object of claim 7, wherein at least a portion of the tube also extends inside of the body.

9. The football style thrown object of claim 8, wherein the tube is at least partially made of a light transmitting material.

10. The football style thrown object of claim 9, wherein the portion of the tube inside of the body is made of a light transmitting material.

11. The football style thrown object of claim 10, wherein at least a portion of the body surrounding the portion of the tube inside of the body is also made of a light transmitting material.

12. The football style thrown object of claim 9, wherein the portion of the tube outside of the body is made of a light transmitting material.

13. The football style thrown object of claim 9, wherein the portions of the tube both inside and outside of the body are made of a light transmitting material.

14. The football style thrown object of claim 13, wherein at least a portion of the body surrounding the portion of the tube inside of the body is also made of a light transmitting material.

15. The football style thrown object of claim 14, wherein the light stick is long enough to be received in the portions of the tube both inside and outside of the body.

16. A football style thrown object, which comprises:

a) an oval body that may be gripped by one hand of the user and passed through the air in the manner of an American football, the oval body having a central portion lying between two rounded noses and being made of a substantially solid, soft, spongy material;

b) a plastic tube encased at least partially within the oval body and located along a longitudinal centerline of the oval body, the plastic tube extending over at least the central portion of the oval body;

c) wherein the plastic tube is made from a light transmitting material and at least the central portion of the oval body is made from a light transmitting material; and d) a light stick removably carried within the tube such that light given off by the light stick will shine radially outwardly through the tube and through the central portion of the oval body to illuminate at least the central portion of the oval body as the oval body is thrown through the air.

17. The football style thrown object of claim 16, wherein the tube extends through at least one of the rounded noses of the oval body with a portion of the tube extending outside of the body, and further including a set of tail fins attached to the portion of the tube extending outside of the body.

18. The football style thrown object of claim 16, wherein the tube has a predeterimed and the light stick is long enough to extend over a majority of the length of the tube.

* * * * *